United States Patent [19]

Sluys

[11] 4,339,215

[45] Jul. 13, 1982

[54] EMBEDDED MARINE PILE HOOP

[75] Inventor: Wesley W. Sluys, Bellingham, Wash.

[73] Assignee: Builders Concrete, Inc., Bellingham, Wash.

[21] Appl. No.: 157,677

[22] Filed: Jun. 9, 1980

[51] Int. Cl.[3] ..... B63C 1/02; E02B 3/20

[52] U.S. Cl. ..... 405/219; 114/263

[58] Field of Search ..... 405/26, 218, 219; 114/230, 266, 267, 263; 52/704, 706

[56] References Cited

U.S. PATENT DOCUMENTS

| | | | |
|---|---|---|---|
| 3,091,203 | 5/1963 | Usab | 405/219 |
| 3,306,053 | 2/1967 | Fulton | 114/266 |
| 3,374,859 | 3/1968 | Dobert | 52/706 |

*Primary Examiner*—David H. Corbin
*Assistant Examiner*—Nancy J. Pistel
*Attorney, Agent, or Firm*—Seed, Berry, Vernon & Baynham

[57] ABSTRACT

A pile hoop for slidably securing the end of a mainwalk or finger float to a marine pile. The pile hoop includes a cylindrical pipe forming a semicircular portion terminating in a pair of parallel legs. A rub shoe extending between the legs allows the semicircular portion and legs to completely surround the pile. The legs are inserted into respective tubes imbedded in the ends of the mainwalk or finger float. Tie rods extending transversely through the float pass through at least a portion of each tube and leg to secure the hoop to the float.

2 Claims, 7 Drawing Figures

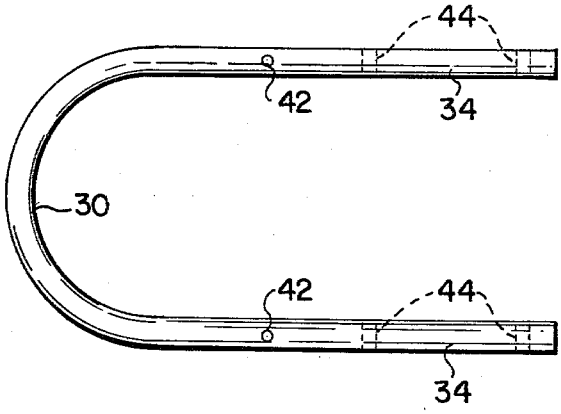
FIG. 4
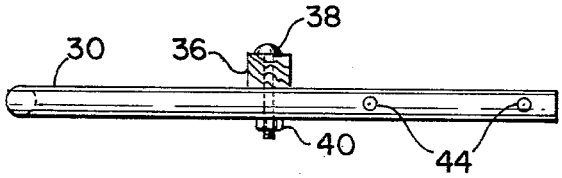
FIG. 5
FIG. 6
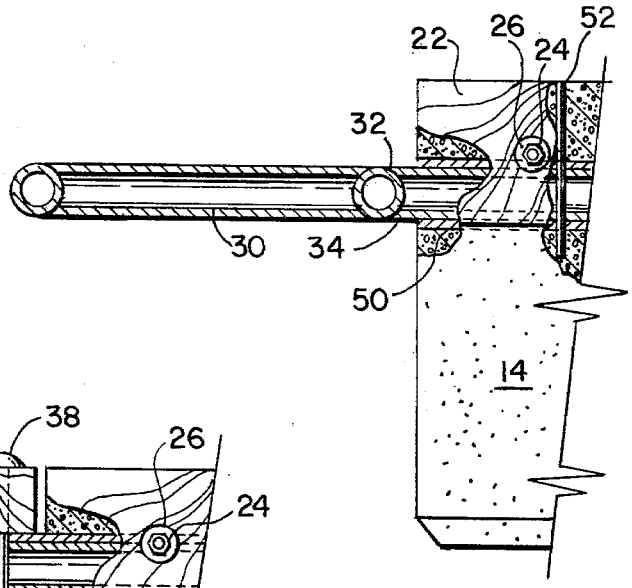
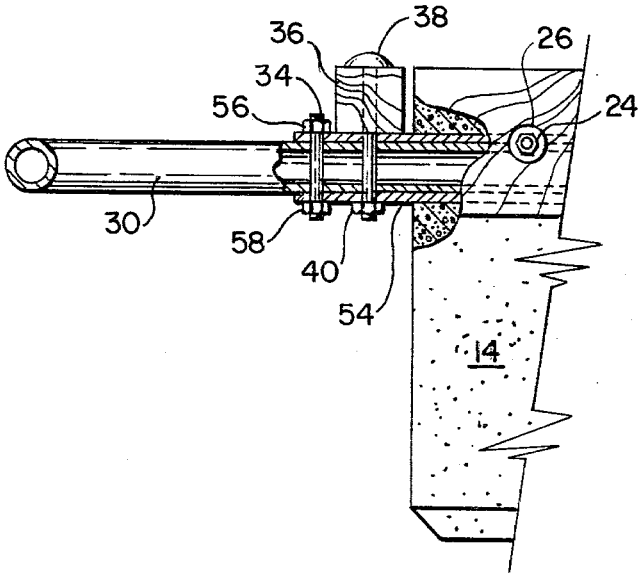
FIG. 7

EMBEDDED MARINE PILE HOOP

BACKGROUND OF THE INVENTION

1. Field of the Invention

This invention relates to marine floats, and more particularly, to a structure for slidably securing marine floats to a marine pile.

2. Description of the Prior Art

Interconnected marine floats are commonly used to form marinas, docks, piers and the like. Various structures must be used to maintain the floats in position since the floats are subjected to forces exerted by currents and tidal changes. One very commonly used technique involves driving marine piles into the sea floor so that they project vertically from the surface of the water in which the floats are placed. Circular structures known as "pile hoops" are placed around the piles and secured to the floats. The hoops loosely surround the piles to allow the floats to rise and fall responsive to tidal changes while limiting the horizontal movement of the floats. Such pile hoops are most typically found at the ends of mainwalk and finger floats, but they may also be positioned in spaced-apart locations along the sides of the mainwalk and finger floats.

A variety of structures are used to secure the pile hoops to the ends of floats, none of which are entirely satisfactory. In one variety of pile hoop, the hoop projects from a flat plate having several holes formed therein through which bolts or inserts imbedded in the float project. The plate is then secured to the float by threading nuts onto the imbedded bolts or inserts. The principal disadvantage of this fastening structure arises from inadequately anchoring the inserts in the float. Most marine floats used with this pile hoop mounting structure are formed by a casing of concrete surrounding a buoyant foam billet. The bolts or inserts do not extend into the concrete for any great distance and are thus easily pulled out by side loads exerted on the float. The inserts may also be pulled out of the float by applying excessive torque to the fastening nuts, or when a pile is not entirely vertical so that it exerts transverse loads on the pile hoop as the hoop slides along the length of the pile. Once the inserts have been pulled out of a float, repair is not possible and the float must be replaced.

A second type of pile hoop mounting structure utilizes a wrap-around mounting plate to which the pile hoop is secured. The wrap-around plate is basically an end plate extending transversely across the end of a float having a pair of side plates projecting perpendicularly therefrom along the sides of the float. Tie rods extending transversely through the float project through respective apertures formed in the side plates to secure the side plates to the float. This mounting structure is far superior to the imbedded-insert structure since it utilizes tie rods which extend completely through the float. However, it is relatively expensive since it uses more material and requires substantially more fabricating and welding effort. Additionally, it is difficult for the side plates to suitably interface with elongated wood wales which typically extend along the upper side edges of the floats to interconnect one float to another. If the wales are to be placed along the outside surface of the side plates, either the float or the wales must be notched to allow the side plates to extend around the sides of the float. If the side plates are placed along the outside surface of the wales, the rigid corners between the end plate and the side plates can potentially damage vessels tieing up at the float. While resilient bumpers can be secured to the corners and side plates, this only adds to the relatively high cost of this type of pile hoop. Additionally, the floats are often not fabricated with a great deal of precision so that the fit between the pile hoop mounting structure and the float is not always satisfactory. Finally, this mounting structure is usually not satisfactory for fairly wide floats because the mounting plate is secured only at its ends. The large span resulting from use of this structure on wide floats allows the mounting plate to bend responsive to transverse forces exerted between the pile and the float.

While pile hoops are thus a highly satisfactory structure for slidably securing marine floats to piles, it is apparent that neither of the above-described mounting structures are both sufficiently inexpensive and sufficiently sturdy.

SUMMARY OF THE INVENTION

It is an object of the invention to provide a mounting structure for a pile hoop which does not rely on imbedded inserts to secure the hoop to a marine float.

It is another object of the invention to provide a pile hoop which does not place a rigid structure along the upper edge of a float which might damage vessels moored at the float.

It is another object of the invention to provide a pile hoop having a relatively low cost stemming from its use of relatively little material and relatively little fabricating labor.

It is still another object of the invention to provide a pile hoop which is extremely versatile in that it can be adapted to floats having any size or shape.

It is a further object of the invention to provide a pile hoop which can be easily and quickly removed and then reinstalled on a marine float in the event of damage.

These and other objects of the invention are provided by a pile hoop mounting structure for a marine float formed by a concrete casing surrounding a buoyant foam core. Several spaced-apart tie rods extend transversely through the float with their respective ends projecting from opposite side walls of the float along its upper edges. The pile hoop includes a preferably semicircular encircling portion, terminating in a pair of parallel mounting legs having a rub block extending therebetween. The encircling portion has an inside transverse dimension slightly larger than the diameter of the pile to allow the encircling portion to loosely surround the pile. A pair of parallel mounting tubes are imbedded in the float with their respective ends accessible at the end wall of the float. The tubes are spaced apart by the spacing between the mounting legs and they have an inside diameter slightly larger than the outside diameter of the mounting legs to allow the mounting legs of the hoop to be inserted in the mounting tubes and secured in place. The transverse tie rods may pass through either an aperture or a notch in the mounting legs to prevent axial movement. Alternatively, the mounting tubes can project from the end wall of the float and respective pairs of bolts may be inserted through the mounting legs and tubes. The rub block may be a rail mounted on the upper surfaces of the mounting legs by respective bolts extending downwardly through the rail and mounting legs. An alternative rubbing block is a length of the same material forming the encircling portion which is secured between the inner edges of the mounting legs.

BRIEF DESCRIPTION OF THE DRAWINGS

FIG. 4 is a top plan view of the pile hoop;

FIG. 5 is a side elevation view of the pile hoop;

FIG. 6 is a cross-sectional view of another embodiment of the pile hoop;

FIG. 7 is a cross-sectional view of still another embodiment of the pile hoop in which the mounting tubes project from the float and the hoop is secured therein by bolts.

DETAILED DESCRIPTION OF THE INVENTION

Figure 1:
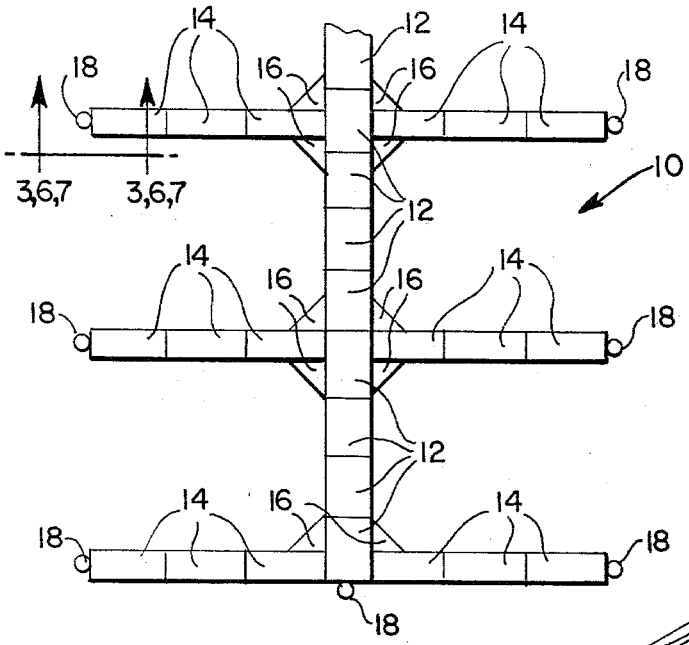
FIG. 1 is a top plan view of a large number of marine floats forming a marina which are slidably secured to marine piles by the inventive pile hoop.

A marina formed by a large number of interconnected floats, each of which has a concrete casing surrounding a buoyant core, is illustrated in FIG. 1. The marina 10 includes mainwalk floats 12 interconnected end-to-end in a row from which a plurality of interconnected finger floats 14 project at a right angle. The finger floats 14 are secured to the mainwalk floats 12 by triangularly shaped gussets 16. A conventional marine pile 18 projects upwardly from the sea floor at the end of the row of mainwalk floats 12 and at the end of each row of finger floats 14. As explained in greater detail hereinafter, the finger floats and mainwalk floats are slidably secured to the piles 18 so that they can rise and fall with tidal changes. However, the piles 18 prevent transverse movement of the floats 12, 14.

Figure 2:
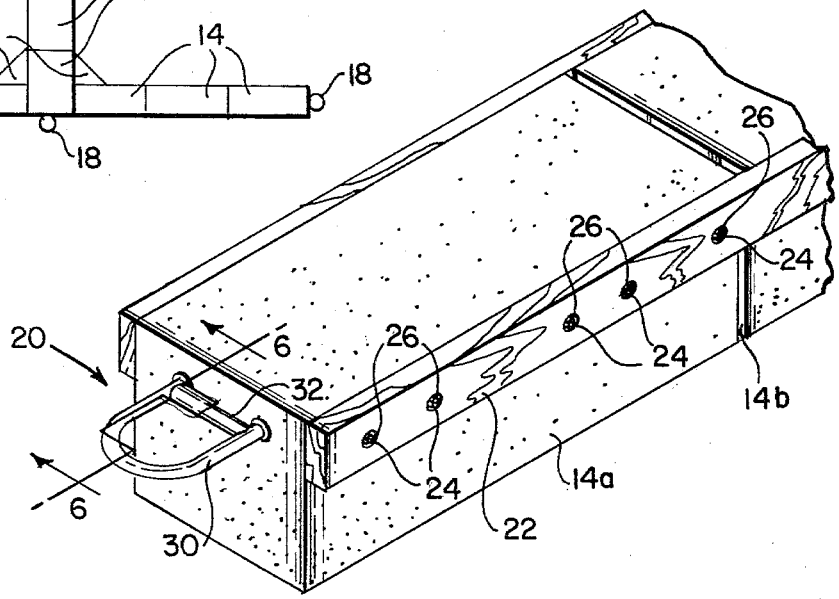
FIG. 2 is an isometric view of a finger float having the inventive pile hoop mounted thereon.

A finger float 14 having a pile hoop 20 of the present invention installed therein is illustrated in FIG. 2. As also illustrated therein, the two adjacent finger floats 14*a*, 14*b* are interconnected by elongated wales 22 extending along the upper side edges of the floats 14 and bridging the gap therebetween. Tie rods 24 extend transversely from one side wall of the float 14 to the other, with their ends projecting through the wales 22. Nuts 26 threaded onto the ends of the tie rods 24 compressively load the concrete forming the casing of the float 14 and secure the wales 22 to the float.

The pile hoop 20 includes an encircling portion 30 having a diameter slightly larger than the diameter of the pile 18, a pair of mounting legs (shown hereinafter) projecting from the encircling portion 30 into the float 14 and a rub block 32 extending from one mounting leg to the other. The encircling portion 30 and mounting block 32 thus surround the pile 18 to prevent transverse movement of the float 14 while allowing the float 14 to move vertically along the pile.

The pile hoop 30 is illustrated in greater detail in FIGS. 4 and 5. As illustrated therein, the encircling portion 30 is semicircular in configuration and terminates in a pair of parallel mounting legs 34 as an integral unit. The pile hoop may be formed of a variety of materials, but metallic pipe bent into the shape illustrated in FIG. 4 can be advantageously used. The pipe is preferably galvanized to allow it to resist the corrosive elements with which it will come in contact during use. The embodiment illustrated in FIGS. 4 and 5 is substantially identical to the embodiment of FIG. 2, except that instead of a rub block 32 welded between the mounting legs 34 as illustrated in FIG. 2, a wooden rail 36 is mounted on the upper edge of the mounting legs 34 by bolts 38 extending downwardly through the mounting legs 34 and fastened by nuts 40. Accordingly, respective apertures 42 are formed in the mounting legs 34 to receive the bolt 38. The mounting legs 34 also have formed therein transverse bores 44 through which, as explained hereinafter, the tie rods 24 extend to secure the pile hoop 20 to the float 14.

Figure 3:
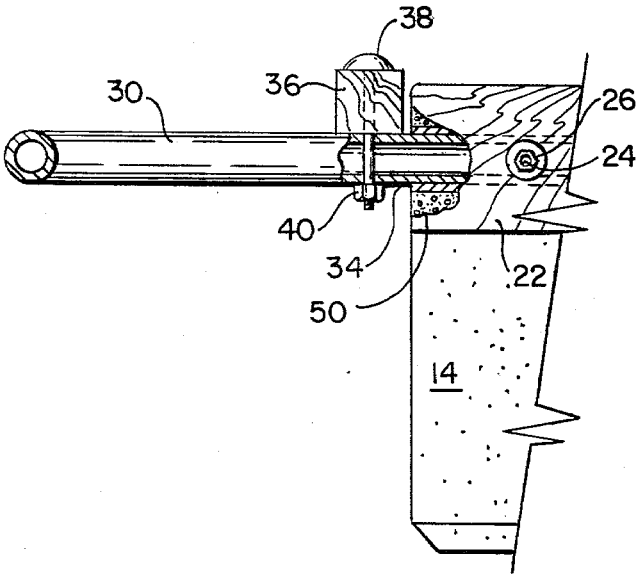
FIG. 3 is a cross-sectional view of one embodiment of the pile hoop.

As shown in FIG. 3, it will be seen that the mounting legs 34 are inserted into mounting tubes 50 imbedded in the concrete casing of the float 14. The mounting tubes 50, which may be steel, plastic or other suitable material, are positioned such that the tie rods 24 are adapted to extend through the mounting tube 50 and hence the mounting legs 34. The tie rods 24 are typically inserted into imbedded cross-tubes so that the tie rods 24 can be removed from or inserted into the float 14 at any time. Thus the tie rods 24 are removed from the float 14, the mounting legs 34 are inserted in their respective mounting tubes, and the tie rods 24 is reinserted in their respective cross-tubes to prevent axial movement of the mounting legs 34.

In another embodiment, as illustrated in FIG. 6, the mounting tubes 50 are positioned beneath the tie rods 24 and a pin 52 extends vertically through the deck of the float 14 and through each of the mounting tubes 50 and mounting legs 34. The pin 52, like the tie rod 24 of FIG. 3, prevents axial movement of the mounting legs 34.

The embodiments illustrated in FIGS. 1–6 utilize mounting tubes 50 which have their ends flush with the end wall of the float 14. The embodiment of FIG. 7, however, utilizes mounting tubes 54 which project from the end walls of the float 14. This allows the mounting legs 34 of the pile hoop 20 to be secured within the mounting tube 54 by the bolt 38 securing the rub block 36 to the legs 34 and by a second bolt 56 fastened by a respective nut 58. The mounting tubes 54 are embedded in the float 14 where they are anchored by the tie rods 24 extending through notches formed in the upper surface of the mounting tubes.

It will be apparent that structures other than those illustrated herein can be used without departing from the invention. For example, the encircling portion 30 need not be semicircular as illustrated herein, but it may be, for example, square either to match a square pile or to carry rollers which roll along the pile 18. Further, the hoop 20 need not be formed from a circular pipe, but bars or rods having other configurations may be used.

I claim:

1. In a marine float formed by a concrete casing surrounding a buoyant foam core and having a plurality of spaced-apart tie rods extending transversely therethrough with their respective ends projecting from opposite side walls of said float along the upper edge thereof, a pile hoop for slidably securing said float to an upstanding pile, comprising;

a hoop having an encircling portion terminating in a pair of parallel mounting legs having a rub block extending therebetween, said encircling portion having an inside transverse dimension slightly larger than the diameter of said pile to allow said encircling portion and rub block to loosely surround said pile; and a pair of parallel mounting tubes embedded in said float with their respective ends exposed at the end wall of said float, said tubes being spaced apart by the spacing between said mounting legs and having a shape and size to conform to the shape and size of said mounting legs to allow the mounting legs of said hoop to be inserted into respective mounting tubes and secured thereto, said mounting tubes and mounting legs extending inwardly to intersect at least one of said tie rods such that said tie rod passes through said mounting tubes and mounting legs to prevent axial movement of said mounting legs.

2. In a marine float formed by a concrete casing surrounding a buoyant foam core and having a plurality of spaced-apart tie rods extending transversely therethrough with their respective ends projecting from opposite side walls of said float along the upper edge thereof, a pile hoop for slidably securing said float to an upstanding pile, comprising;

a hoop having an encircling portion terminating in a pair of parallel mounting legs having a rub block extending therebetween, said encircling portion having an inside transverse dimension slightly larger than the diameter of said pile to allow said encircling portion and rub block to loosely surround said pile; and a pair of parallel mounting tubes embedded in said float with their respective ends projecting beyond the end wall of said float, said tubes being spaced apart by the spacing between said mounting legs and having a shape and size to conform to the shape and size of said mounting legs to allow the mounting legs of said hoop to be inserted into respective mounting tubes, said mounting legs being fastened within said mounting tubes by respective bolts extending through said legs and tubes.

* * * * *